US008756887B2

(12) United States Patent
Hauser

(10) Patent No.: US 8,756,887 B2
(45) Date of Patent: Jun. 24, 2014

(54) THERMAL INSULATION ELEMENT WITH VENTILATION DUCTS

(75) Inventor: Gerd Hauser, Graefelfing (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 222 days.

(21) Appl. No.: 12/601,988

(22) PCT Filed: Jun. 2, 2008

(86) PCT No.: PCT/EP2008/004372

§ 371 (c)(1), (2), (4) Date: Nov. 25, 2009

(87) PCT Pub. No.: WO2008/145402

PCT Pub. Date: Dec. 4, 2008

(65) Prior Publication Data

US 2010/0175340 A1 Jul. 15, 2010

(30) Foreign Application Priority Data

May 31, 2007 (DE) ..... 10 2007 025 469

(51) Int. Cl.
*F24F 7/04* (2006.01)

(52) U.S. Cl.
USPC ..... 52/302.3; 52/220.8; 454/185; 454/237

(58) Field of Classification Search
USPC ..... 52/302.3, 302.1, 302.4, 503, 220.1, 52/220.2, 220.3, 220.8; 454/185, 237; 237/46
See application file for complete search history.

(56) References Cited

U.S. PATENT DOCUMENTS

| | | | | | |
|---|---|---|---|---|---|
| 127,497 | A | * | 6/1872 | McGiniss | 52/302.3 |
| 2,645,824 | A | * | 7/1953 | Titsworth | 52/302.3 |
| 3,789,747 | A | * | 2/1974 | Wasserman et al. | 454/186 |
| 4,295,415 | A | * | 10/1981 | Schneider, Jr. | 454/185 |
| 4,379,449 | A | * | 4/1983 | Wiggins et al. | 126/631 |
| 4,411,255 | A | * | 10/1983 | Lee | 126/618 |
| 5,761,864 | A | * | 6/1998 | Nonoshita | 52/302.3 |

(Continued)

FOREIGN PATENT DOCUMENTS

| | | |
|---|---|---|
| DE | 33 29 789 | 3/1985 |
| DE | 36 18 457 | 12/1986 |

(Continued)

OTHER PUBLICATIONS

Japan Office action in counterpart application No. JP2010509749, dated Jul. 17, 2012, along with a partial English-language translation thereof.

*Primary Examiner* — Andrew J Triggs
(74) *Attorney, Agent, or Firm* — Greenblum & Bernstein, P.L.C.

(57) ABSTRACT

An element for thermal insulation of a building, which is provided for attachment to an exterior wall of the building on the outside. The element includes at least one duct which is surrounded by portions of the element on all sides except for in edge areas of the element. In one or more individual areas of the element the at least one duct extends towards an edge of the element such that, when the element is attached to the exterior wall, at least one connection of the at least one duct to the exterior wall is formed at at least one desired location, through which air can be guided into the building or out of the building.

23 Claims, 1 Drawing Sheet

(56) References Cited

U.S. PATENT DOCUMENTS

| | | | | |
|---|---|---|---|---|
| 6,195,946 | B1 * | 3/2001 | Lott et al. | 52/100 |
| 6,240,693 | B1 * | 6/2001 | Komasara et al. | 52/439 |
| 6,584,735 | B2 * | 7/2003 | Burton | 52/95 |
| 6,754,997 | B2 * | 6/2004 | Bonin | 52/220.1 |
| 8,051,611 | B2 * | 11/2011 | Serino et al. | 52/169.14 |
| 2002/0083662 | A1 * | 7/2002 | Burton | 52/199 |
| 2006/0283113 | A1 * | 12/2006 | Trotter | 52/302.3 |
| 2008/0034690 | A1 * | 2/2008 | Gartz et al. | 52/302.3 |
| 2010/0175340 | A1 * | 7/2010 | Hauser | 52/220.1 |

FOREIGN PATENT DOCUMENTS

| | | | | |
|---|---|---|---|---|
| DE | 3618457 | A1 * | 12/1986 | E04B 1/76 |
| DE | 94 21 508 | | 2/1996 | |
| DE | 297 08 620 | | 8/1997 | |
| FR | 2522121 | * | 2/1982 | |
| FR | 2522121 | A * | 2/1982 | F24F 13/06 |
| FR | 2 522 121 | | 8/1983 | |
| JP | 61-170753 | | 10/1986 | |
| JP | 6-235254 | | 8/1994 | |
| JP | 2004-60288 | | 2/2004 | |
| JP | 3642589 | | 4/2005 | |

* cited by examiner

THERMAL INSULATION ELEMENT WITH VENTILATION DUCTS

CROSS REFERENCE TO RELATED APPLICATIONS

The present application is a U.S. National Stage of International Application No. PCT/EP2008/004372 filed Jun. 2, 2008, which published as WO 2008/145402 A2 on Dec. 4, 2008, the disclosure of which is expressly incorporated by reference herein in its entirety. Further, this application claims priority under 35 U.S.C. §119 and §365 of German Application No. 10 2007 025 469.7 filed May 31, 2007.

BACKGROUND OF THE INVENTION

1. Field of the Invention

The invention relates to an element for the thermal insulation of a building.

2. Background Description

In many cases the thermal insulation of a building is carried out by attaching thermal insulation elements to the exterior wall of the building. This can also often be carried out by retrofitting. The thermotechnical improvement of exterior walls is thus generally carried out with composite thermal insulation systems which have a thermal insulation in the form of polystyrene rigid-foam panels attached to the exterior wall on the outside. In the course of the thermotechnical improvement of a building, it is often useful not only to improve the insulation of the walls, but also to provide a controlled ventilation. Central ventilation systems necessary for this purpose often cannot be realized in existing buildings due to the low ceiling heights usually available and the enormous space requirements for ventilation ducts. The ventilation heat losses thus cannot be reduced as efficiently as transmission heat losses. It makes sense to carry out a retrofitting accommodation of ventilation systems only in buildings with high floor-to-floor heights. In this case suspended ceilings are installed, in which the ventilation ducts are accommodated. In buildings constructed after the second world war, the floor-to-floor heights are generally not sufficient for retrofitting suspended ceilings. In this case it has hitherto been possible only to realize decentralized systems that render possible a room-by-room supply with fresh air. However, the heat exchanger efficiency of systems of this type is much lower than the efficiency of central systems. The ventilation efficiency is also lower. Decentralized systems of this type are also expensive. The reason for this, among other things, is that a large number of fans are necessary. One starting point that is suitable in particular for retrofitting central ventilation systems is the accommodation of ventilation ducts in the exterior insulation. If thermal insulation is attached to the outside of the exterior wall in the course of the thermotechnical improvement of a building, ventilation ducts for a central ventilation system can be accommodated therein. To this end metallic spiral pipes are inserted into recesses made on-site in the exterior insulation at scattered intervals. For the interior area of buildings, ventilation ducts of rigid polystyrene foam are available with circular internal cross section and square external cross section. Suitably produced exterior insulation panels with integrated ventilation ducts and required soundproofing properties do not exist as yet. A thermal insulation is known from JP 2004-060288 A2, which in individual areas has a hollow duct, through which air necessary for the ventilation can flow. This hollow duct is formed in that the generally thicker thermal insulation is composed of only a thin metal insulator in selected areas. The insulation element is therefore thinner in this area. When the insulation element is attached to the exterior wall, the said ventilation duct is formed between the metal insulation and the exterior wall.

DE 36 18 457 discloses a heat-insulating façade with an insulating layer, which is composed of insulating panels, arranged on the outside of the structure wall to be protected. A covering layer, in particular a plaster layer, is used to cover towards the outside. Ducts are provided in the insulating panels, which ducts run one next to the other in an approximately perpendicular or oblique manner and thereby follow the surface extension of the insulating layer. The ends of the ducts are open to the surroundings. The ducts are used to carry away undesirable moisture from the insulation. The resulting duct system does not have any connection to the interior of the building.

SUMMARY OF THE INVENTION

The aim of the present invention is to disclose an improved system for the thermal insulation and ventilation of a building. To this end, in particular a plate-like element is proposed for the thermal insulation of a building, which element is provided for attachment to an exterior wall of a building, wherein the element has ducts that can be used as ventilation ducts. As a rule, this will be a plate-like element that is to be attached to a flat wall. However, the element can also be round, for example, if it has to be attached to a round wall. The element is characterized in that the ducts, apart from edge areas, are surrounded by the element on all sides. Thus, the ducts are located inside the elements and not at the edge. Consequently, the ducts are not partially delimited by the exterior wall. Of course, the element cannot surround the ducts on all sides in the edge areas. Instead, the ducts running through the element are open at the end of an element, so that air can flow from one element into the adjacent element. In individual areas of the element the ducts extend towards an edge of the element such that, when the element is attached to the exterior wall, connections of the ducts to the exterior wall are formed at desired locations. These are the locations at which the air is to be guided into the building or out of the building. A connection of the ducts to the exterior wall is unavoidable at these locations, despite the aforementioned disadvantages. This type of arrangement of the ducts has several advantages. If the ducts, as known in the prior art, are partially surrounded by the exterior wall, the sound present in the ventilation ducts is transferred through the exterior wall into the interior of the building. This is obviously unpleasant for the residents or users of the building. The sound in the ventilation ducts can thereby either originate from flow noises or can be carried along, as it were, from the rooms to be aired or ventilated. Furthermore, gases or gas mixtures with an unpleasant odor can escape from the exterior wall, in particular in the case of a newly built exterior wall. If the ventilation duct were connected directly to the exterior wall, these gases or gas mixtures with an unpleasant odor would be able to reach the inlet air in a higher concentration. The aforementioned disadvantages are avoided with the plate-like element according to the invention in a simple manner.

A particularly preferred embodiment provides that the element can be obtained in that the duct is formed by the removal of insulating material during the production of the one-piece element, without further steps being necessary. Only enough insulating material is removed thereby so that in the area of the ducts the thermal transmission value is no more than 25% higher, preferably no more than 20% higher, than in the remaining area of the plate-like construction element. The duct is thus provided in a very simple manner. Correspondingly prefabricated elements are produced, which can be processed at the building site even by personnel without special training. Through the limited increase of the thermal transmission value, the formation of undesirable thermal bridges is largely avoided. The insulating material conventionally used is thick enough that the increase in the thermal transmission value through the removal of insulating material in the areas in which the desired ventilation ducts are to be arranged remains within the cited, reasonable limits.

A suitable building material for the plate-like element is a polystyrene rigid-foam panel. Polystyrene rigid-foam panels of this type are known as thermal insulation elements and have good properties for thermal insulation and sound-proofing. Moreover, they are easily workable.

A particularly simple and thus inexpensive method for forming the duct is to cut out the insulating material with a hot wire. This has been tried and tested in practice in particular with polystyrene rigid-foam panels. This is a relatively cost-effective method which is known in the prior art.

In order to improve the desired sound-proofing and sound damping, the walls of the ducts can be embodied in a sound-proofing and/or sound damping manner. To this end it is possible, for example, to provide holes with a diameter of 1 to 2 mm and a depth of approximately 10 to 12 mm in the insulating material starting from the duct walls. A micro-perforated absorber is thus created, which is known to act in a sound-damping manner.

In order on the one hand to achieve a sufficiently large cross section of the duct, which renders possible the desired flow through, and on the other hand to limit the increase in the thermal transmission value, it is expedient if the duct is essentially rectangular, wherein the width of the duct is approximately 10 times as large as the depth. Of course, a precisely rectangular form is not important here. The important factor is only that the depth of the duct determines the increase in the thermal transmission value in the region of the duct. In order to optimize the thermal properties of the duct overall, it is more favorable if the thermal transmission value is somewhat increased in wider regions than having to tolerate a clear increase in smaller areas. It is therefore more favorable to embody the ducts to be much wider than deep. A favorable measurement for the width of the duct is approximately 30 cm. If the given ratio of width and depth is followed, this would correspond to a depth of approximately 3 cm.

If it should prove easier to produce a duct with an approximately circular cross section for reasons of production engineering, this is to be accepted, despite the above-mentioned advantages of approximately rectangular ducts that are much wider than deep.

In any case, the thickness of the element should be at least 10 cm. This ensures that the thermal transmission value is also sufficiently low in the region in which the ducts are located.

The element preferably has connection devices, which are arranged such that several elements can be connected such that a desired duct system is produced. In particular, the elements can have recesses and mating parts matched thereto, such as corresponding tongues and grooves on the edges, so that even non-specialized staff will interconnect the elements in an appropriate manner. Errors in assembly can thus be avoided.

A thermal insulation system for a building can thus be produced with a plurality of the above-mentioned elements. Openings are to be made for this purpose in the exterior wall of the building, which openings connect the interior of the building to the duct system, through which the air flows into the plate-like elements. The ducts in the plate-like elements form precisely this duct system.

If the openings in the exterior wall are embodied so as to be closeable, the ventilation can be controlled as required for individual rooms.

The production of an above-mentioned element requires little expenditure. The elements can be produced simply, for example, in that the ducts are formed by removing insulating material from a one-piece element. As already mentioned, a commercially available polystyrene rigid foam panel can be used, from which the insulating material can be easily removed with a hot wire.

BRIEF DESCRIPTION OF THE DRAWINGS

Without restricting generality, the invention is described below based on an exemplary embodiment.

They show.

DETAILED DESCRIPTION OF THE INVENTION

Figure 1A:
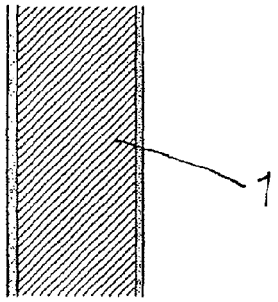
FIG. 1*a*: An existing exterior wall according to the prior art.
Figure 1B:
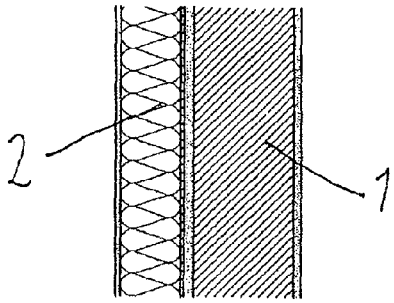
FIG. 1*b*: An exterior wall thermotechnically improved according to the prior art.
Figure 2A:
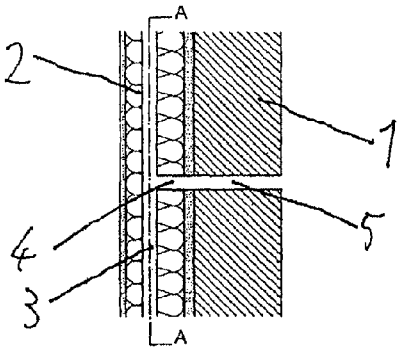
FIG. 2*a*: A vertical section of an improved exterior wall with ventilation ducts.
Figure 2B:
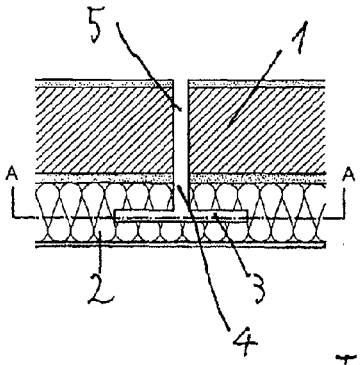
FIG. 2*b*: A horizontal section of an improved exterior wall with ventilation ducts.
Figure 2C:
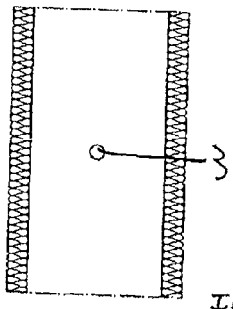
FIG. 2*c*: A further section of an improved exterior wall with ventilation ducts.

FIG. 1*a* shows an existing exterior wall 1, as is known and widespread in the prior art. If one wants to improve the often poor thermal insulation, a thermally insulating element 2 of a polystyrene rigid-foam panel that is at least 10 cm thick can be attached to the outside, as shown in FIG. 1*b*. In FIG. 2*a*, a thermotechnically improved exterior wall 1 with a ventilation duct 3 is shown in vertical section. It is discernible that the ventilation duct 3 is located in the center of the thermally insulating element 2 and extends from the bottom upwards. At selected locations 4 the ventilation duct extends up to the edge of the rigid foam panel. At these locations 4 the exterior wall has an opening 5, so that the air from the ventilation duct 3 can flow into the respective room of the building or accordingly can flow out of the room. FIG. 2*b* shows a vertical section so that the width of the ventilation duct 3 is discernible. The further section in FIG. 2*c* shows that the ventilation ducts 3 have a circular cross section.

LIST OF REFERENCE NUMBERS

1 Exterior wall
2 Thermally insulating element
3 Ventilation duct
4 Extensions
5 Exterior wall openings

The invention claimed is:

1. A panel for thermal insulation of a building, which is provided for attachment to an exterior wall of a building on an outside, wherein the panel comprises:

at least one duct which is surrounded by portions of the panel on all sides except for in edge areas of the panel, wherein in one or more individual areas of the panel the at least one duct extends towards an edge of the panel such that, when the panel is attached to the exterior wall, at least one connection of the at least one duct to the exterior wall is formed at at least one desired location, through which air can be guided into the building or out of the building, wherein the at least one duct of the panel is structured and arranged to connect with at least one duct of an adjacent panel to form a duct system, and wherein the at least one duct is at least one ventilation duct.

2. The panel of claim 1, wherein the panel is structured and arranged for attachment to an outside surface of the exterior wall of the building.

3. The panel of claim 1, wherein the panel is structured and arranged as a planar element.

4. The panel of claim 1, wherein the panel comprises at least one region of removed insulating material from a layer of insulating material, which at least one region forms the at least one duct.

5. The panel of claim 4, wherein the at least one duct is formed during production of the panel, without further steps being necessary to provide the at least one duct.

6. The panel of claim 1, wherein the at least one duct is formed in the layer of insulating material by cutting out insulating material with a hot wire.

7. The panel of claim 1, wherein a thermal transmission value in the one or more individual areas is no more than 25% higher than a thermal transmission value in a remaining area of the panel.

8. The panel of claim 7, wherein the thermal transmission value in the one or more individual areas is no more than 20% higher than the thermal transmission value in the remaining area of the panel.

9. The panel of claim 4, wherein the layer of insulating material is a polystyrene rigid-foam panel.

10. The panel of claim 1, wherein walls of the at least one duct are at least one of embodied and structured and arranged in at least one of a sound-proofing and sound damping manner.

11. The panel of claim 1, wherein the at least one duct comprises:

an essentially rectangular cross-section;

a width; and a depth, wherein the width is approximately ten times as large as the depth.

12. The panel of claim 1, wherein the at least one duct comprises a width of approximately 30 cm.

13. The panel of claim 1, wherein the at least one duct comprises an approximately circular cross-section.

14. The panel of claim 1, wherein the at least one duct comprises a thickness of at least 10 cm.

15. The panel of claim 1, further comprising connection devices structured and arranged such that a plurality of panels can be connected to one another such that a desired duct system is produced.

16. The panel of claim 15, wherein the connection devices comprise recesses and mating parts matched to the recesses.

17. A thermal insulation system for a building having an exterior wall, formed from a plurality of panels according to claim 1, wherein the exterior wall of the building comprises openings to passages in the exterior wall, which openings connect an interior of the building to a duct system formed by the plurality of panels each having the at least one duct therein.

18. The thermal insulation system according to claim 17, wherein the openings in the exterior wall are closeable.

19. A method for producing the panel according to claim 4, comprising removing insulating material from the layer of insulating material to form the at least one duct.

20. The method according to claim 19, wherein the layer of insulating material comprises a one-piece insulation panel.

21. The method according to claim 19, wherein the at least one duct is formed during production of the panel, without further steps being necessary to provide the at least one duct.

22. The method according to claim 19, wherein the removing comprises cutting out the insulating material with a hot wire.

23. A panel for the thermal insulation of a building, comprising:

a layer of insulating material having at least one duct connection edge area;

at least one duct formed within the layer of insulating material and extending to the at least one duct connection edge area; and at least one extension duct that extends from the at least one duct towards a surface positionable adjacent to a wall, the at least one extension duct being positionable to form an air flow path from a passage in the wall to the at least one duct, wherein the at least one duct of the panel is structured and arranged to connect with at least one duct of an adjacent panel to form a duct system, and wherein the at least one duct is at least one ventilation duct.

* * * * *